United States Patent [19]

Mikhailovsky et al.

[11] Patent Number: 4,695,187

[45] Date of Patent: Sep. 22, 1987

[54] CONCRETE ARCH BURIED BRIDGE

[75] Inventors: Leonid Mikhailovsky, Edmonton; Jay G. Ramotar, St. Albert, both of Canada

[73] Assignee: Bridginfill Design Ltd., Edmonton, Canada

[21] Appl. No.: 759,952

[22] Filed: Jul. 29, 1985

[30] Foreign Application Priority Data

Aug. 2, 1984 [CA] Canada ..... 460229

[51] Int. Cl.[4] ..... E21D 9/00; E21D 11/14; E01F 5/00

[52] U.S. Cl. ..... 405/124; 405/132; 405/150; 52/88

[58] Field of Search ..... 405/124–126, 405/132, 134, 135, 137, 150, 49; 52/86–89, 334, 329, 339, 169.5; 285/424

[56] References Cited

U.S. PATENT DOCUMENTS

| | | | |
|---|---|---|---|
| 973,708 | 10/1910 | Schlafly | 285/424 X |
| 1,049,543 | 1/1913 | Smith | 405/124 X |
| 1,218,999 | 3/1917 | Henning | 52/329 |
| 1,771,167 | 7/1930 | Dolan | 285/424 X |
| 2,126,091 | 8/1938 | Claybaugh | 405/124 |
| 3,508,406 | 4/1970 | Fisher | 405/124 |
| 3,638,434 | 2/1970 | Delaere | 405/126 |
| 4,010,617 | 3/1977 | Fisher | 405/150 |
| 4,211,504 | 7/1980 | Sivachenko | 405/150 X |
| 4,252,464 | 2/1981 | Habib | 405/124 X |
| 4,390,306 | 6/1983 | Fisher | 52/89 X |

FOREIGN PATENT DOCUMENTS

| | | | |
|---|---|---|---|
| 2,140,848 | 12/1984 | United Kingdom | 405/126 |

*Primary Examiner*—Cornelius J. Husar
*Assistant Examiner*—Todd G. Williams
*Attorney, Agent, or Firm*—Bachman & LaPointe

[57] ABSTRACT

A concrete arch buried bridge made up of upper and lower arched parts of corrugated metal provided with a reinforced concrete cap with a footing at each side, having an abutment extending inward under the margin of the upper part. The margins of the respective upper and lower parts have a connection which can be left loose to enable their relative movement and tightened so that they are rigidly held together. Each margin of the lower part has a permanent connection to the adjacent abutment which allows movement in the upward and downward direction, but resists lateral movement. The bridge is constructed by first placing the lower part on a compacted fill and making the connection between the margins of the upper part and the lower part. Then, the concrete cap is formed on top of the upper part and when the concrete is set sufficiently, the connection loosened and the fill completed on top of it. The weight of the concrete and the fill will cause the upper part to settle and move downward relative to the lower part. When the structure has settled the connection may either be tightened or left somewhat loose with provision made to prevent the lower part rising.

13 Claims, 9 Drawing Figures

CONCRETE ARCH BURIED BRIDGE

BACKGROUND OF THE INVENTION

1. Field of the Invention

This invention relates to a concrete arch buried bridge.

2. Description of the Prior Art

Examples of such structures are shown in Canadian Pat. Nos. 749,630, Fisher (1967), 804,292, Fisher (1969), 1,143,170, Peterson (1983) and U.S. Pat. No. 3,508,406, Fisher (1971).

Some of these structures are supported by footings which, in turn, rest in the ground on a permanent natural bed. Other types have no footings, but merely buttresses, capable of carrying only horizontal stresses. A further type is provided with laterally extending arms which receive support from underlying compacted fill as well as support from a bottom lining of the conduit.

The type of concrete arch buried bridge to which the present invention relates is one which employs a lower part or lining which rests on a fill and an upper part or lining connected to it. The upper part has a reinforced concrete cap connected to it. Usually a connection is made between the upper part and a lower part at their lateral margins to form a conduit prior to application of any load to the upper part.

A disadvantage of this type of structure is that the upper part tends to settle, following its construction, more than does the lower part. This stresses the lower part, primarily adjacent its lateral margins, where the structure is weakest. So without special protective measures this stress could be ultimately lead to localized failure. Attempts have been made to overcome this by providing a well compacted select granular fill so as to reduce settling to a minimum. However, this is uncertain, because, among other things, the moisture content of the fill can fluctuate.

Having regard to the foregoing, it is an aim of the present invention to provide a construction which avoids these disadvantages and provides certain positive advantages as will be evident from the following description.

SUMMARY OF THE INVENTION

In accordance with one form of the invention, a concrete arch buried bridge comprises an upper arched structure conveniently formed of sheet corrugated metal, over which is formed a cap of reinforced concrete. The concrete cap terminates at each lateral side of the upper part in integral footings which each includes an abutment which extends inwardly beneath the lateral margins of the upper part and preferably has a downward projection keying into the fill.

Desirably, the bridge also includes a lower part which is also conveniently formed from sheet corrugated metal, but may also be made of concrete, or a combination of metal and concrete. The lower and upper parts together form a closed conduit substantially oval in cross-section.

In accordance with the invention, where a lower part is used, a special connection is made between the adjacent lateral margins of the upper and lower parts which enables the parts to be fixedly joined or released for relative movement to one another.

The connection further retains the margin of the lower part in fixed horizontal relationship with the adjacent footing, but permits relative vertical movement therebetween. The structure thereby allows for the settling of the upper part of the bridge, while avoiding the overstressing of its lower part.

A preferred concrete arch buried bridge is constructed as follows. A compacted bed is prepared by excavating or filling or both, and a lower concave part is placed on the bed. A connection is then made to each lateral margin of the lower part and to each lateral margin of the upper part so that the upper and lower parts are connected together. At this stage, the shape of the conduit may have to be maintained by means of ties and struts.

A concrete cap is then formed over the top lining with footings projecting inwardly at each side to provide abutments, while the margins of the respective upper and lower parts are held together. Once the concrete has set, to the desired degree, the connections are loosened so that the margins of the upper and lower parts can move relative to each other. The ties and struts, if present, are removed. At this stage, fill is placed on the upper part. The weight of the fill will cause settling of the upper part and movement of its lower margins downward relative to the upper margins of the lower part. Once this settling is completed, the connection between the upper and lower parts may be tightened or left loosely connected. In the latter case, special measures should be taken to ensure that the bottom part does not rise. This may include the attachment of heavy blocks or wings to the lower part extending under the fill. In some cases the settlement of the fill cannot be predicted accurately and it may continue over a period of time. In such instances, it is preferable that the connection between the upper and lower parts remain loose so as to permit a continued relative movement of the parts. The ability to accommodate settlement allows structures with spans larger than those shown in the prior art, as well as utilization of lower quality and less expensive fill material.

In one embodiment of the invention, each inwardly extending abutment of the concrete cap has a substantially horizontal platform to which connecting means is anchored, joining the margins of the upper and lower parts together and to the abutment. A preferred connection means has a base plate sitting on and anchored to the platform, with an inwardly and upwardly sloped perforated connecting plate joined to it and to which the margin of the upper part is bolted. Spaced inwardly, a flange extends upwardly from the base plate with slots to receive frictionless bolts extending through it and the margin of the lower part. The connection is such that the lower part has a capability of limited up and down movement relative to the abutment but is prevented from lateral movement.

In another embodiment of the invention, each inwardly extending abutment has an inwardly and downwardly sloping platform merging into a substantially vertical platform. A first connecting member connects the margins of the respective upper and lower parts. A second connecting member makes a connection of the lower part, inward of its margin, to the abutment and thus anchors the assembly of the upper and lower parts to the abutment. The first connecting member may be an angle iron, whose flanges are provided with spaced-apart slots. The margins of the respective parts are bolted to the respective flanges for alternative movement relative to one another or for rigid connection. A preferred form of the second connecting member includes a mounting plate provided with slots to receive anchor bolts from the concrete extending through them. The bolts are provide with frictionless washers to allow limited movement, in the up and down direction, of the plate relative to the abutment. Connected to this mounting plate is an inwardly and downwardly extending mounting plate provided with bolt holes so that the lower part can be connected to it at positions inward of the margin.

The invention also contemplates a method of constructing the last described embodiment of a concrete arch buried bridge. First, a fill is prepared and a lower arched corrugated metal part placed on it. An upper part is then placed in complementary relationship to the lower part and an adjustable connection made connecting the parts rigidly. A second connecting member is then attached to the lower part just above the ground. A concrete cap is then formed over the upper part, with a footing having an abutment extending inwardly at each side beyond the margins of the upper and lower parts providing a joint with the second connecting member. Once the concrete of the footing and the cap has set, the first connection is loosened to allow relative up and down movement between the upper and lower part and between each margin of the lower part and the abutment via the second connnecting member which allows limited movement in the upward and downward direction but prevents lateral movement. A fill is then placed over the conduit so installed to allow the parts to settle. The first connections may be tightened or left loose as desired.

BRIEF DESCRIPTION OF THE DRAWINGS

Having thus generally described the invention, it will now be illustrated by reference to the accompanying drawings, which show preferred embodiments, and in which.

DESCRIPTION OF THE PREFERRED EMBODIMENTS

Referring more particularly to the drawings, the invention will be described in greater detail.

Figure 2:
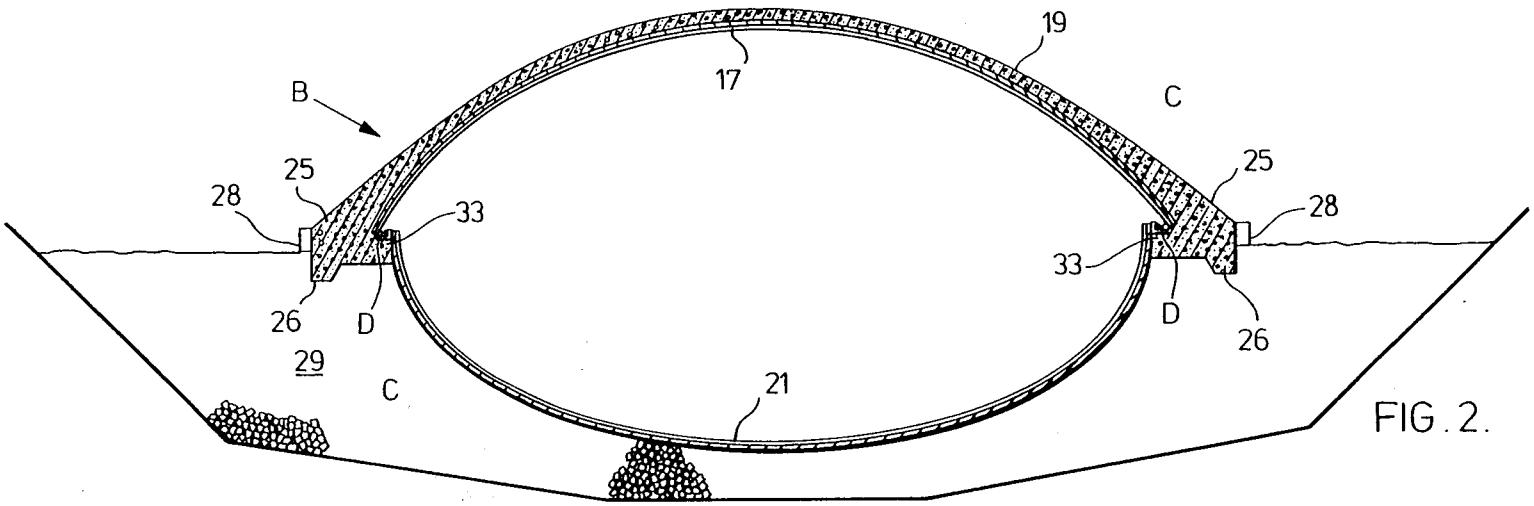
FIG. 2 is a transverse cross-section along the line 2—2 of FIG. 1 (transversely through the bridge)
Figure 1:
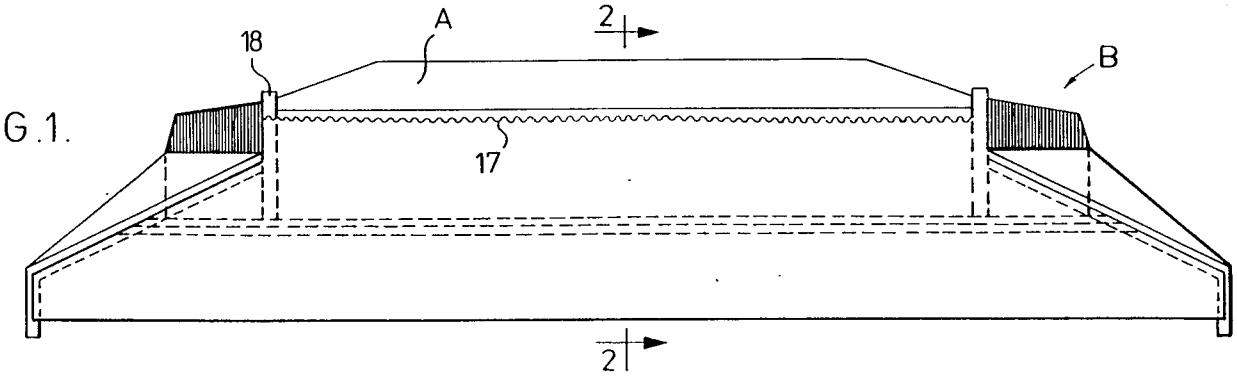
FIG. 1 is a longitudinal cross-section through a concrete arched bridge, according to the invention, underlying a road.

FIG. 1 is a transverse cross-section through a highway showing a concrete arch buried bridge running underneath it. The roadway is indicated by A, and the culvert by B. To each side of the slab is a retaining block or curb 18.

The bridge B is embedded in a fill C. the bridge B includes a wide elongated upper arched corrugated steel part 17 and a lower wide elongated arched corrugated steel part 21. The parts 17 and 21 are connected to form a conduit or passage of substantially oval shape in cross-section.

A reinforced elongated concrete cap or panel 19 covers the upper part 17. The cap 19 terminates at each side in integral footings 25. In accordance with the invention, each footing 25 is formed with an inwardly extending abutment 33, underlying a margin of the upper part 17. In this case, the abutment 33 is provided with a more or less horizontal narrow elongated platform **33*a*** which supports a connecting member D as will be described.

A portion 29 of the fill C, located underneath the footings 25, is of granular fill material. This may desirably be pit run gravel compacted, for example, to about 90% of the Standard Proctor density at optimum moisture content. Or, the fill material 29 can be crushed gravel. The fill is placed up to the bottom of the footings 25 in 150 mm lifts.

In accordance with the invention, the margins of the upper part 17 and the lower part 21 are connected together by means of a releasable connection, provided by the connection member D.

Figure 3:
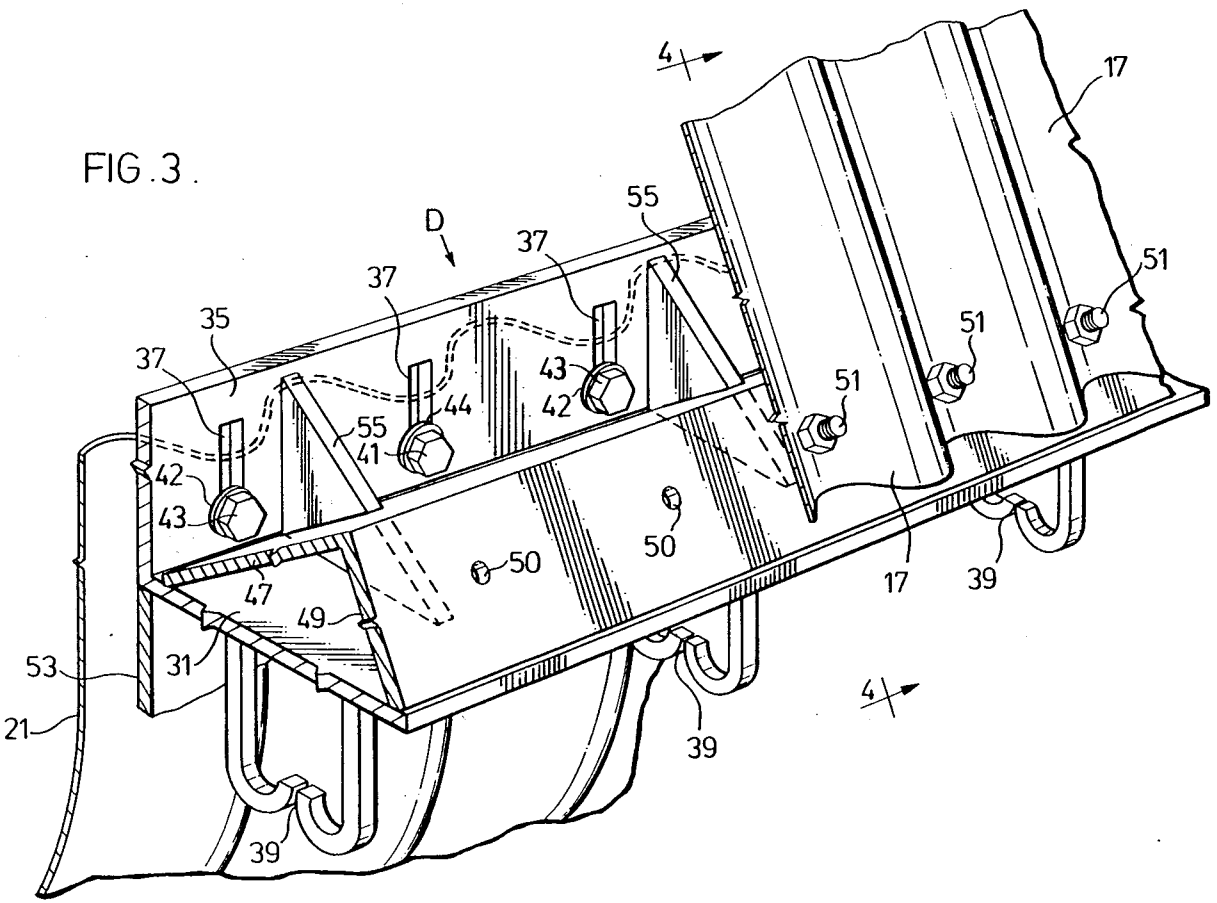
FIG. 3 is an enlarged fragmentary perspective cross-section view of the connection between the margins of the upper and lower parts showing specially the structure of a connecting member which links them together.
Figure 4:
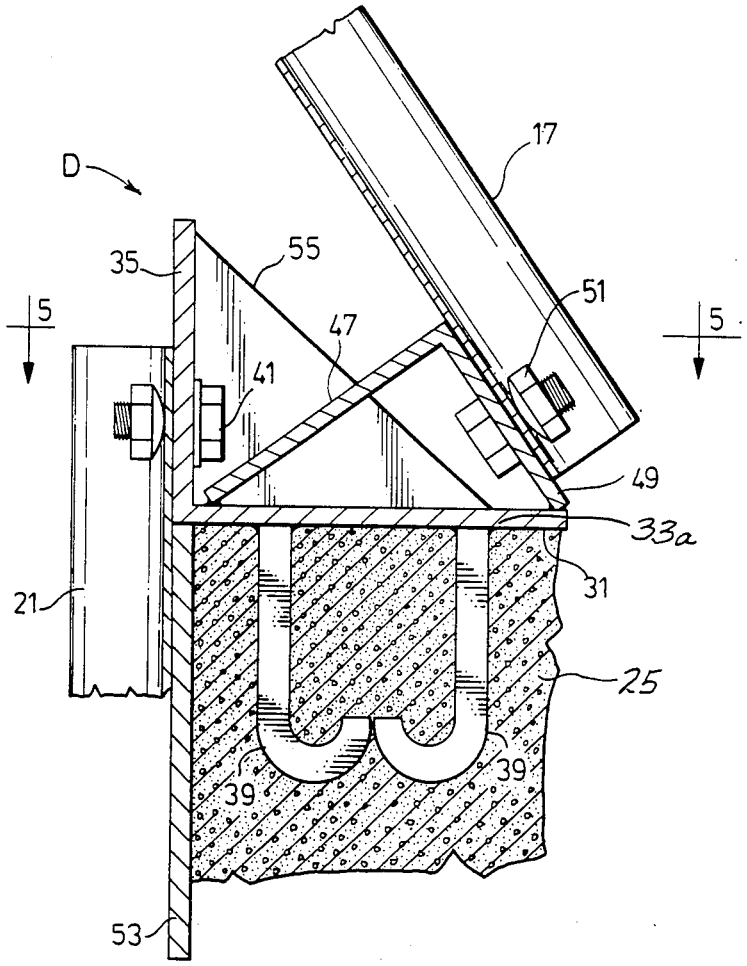
FIG. 4 is a fragmentary vertical cross-section as along the line 4—4 of FIG. 3.
Figure 5:
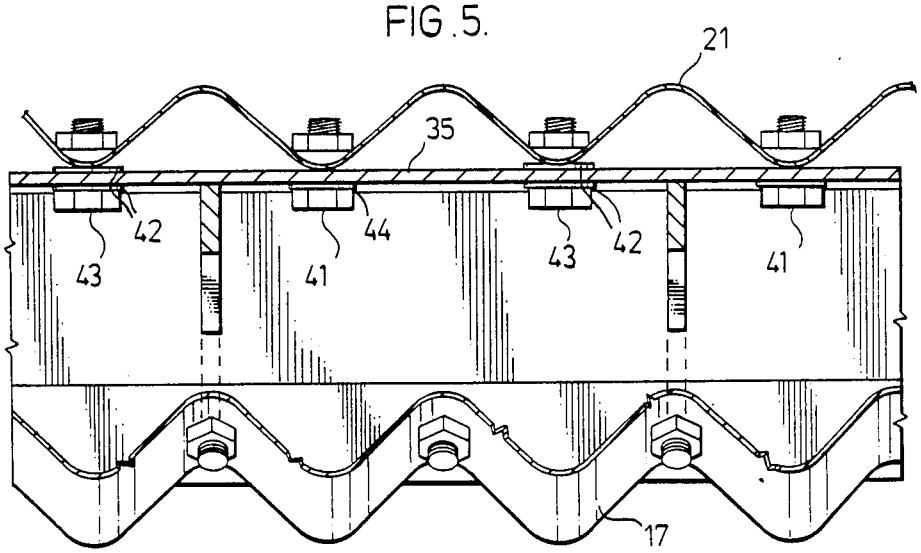
FIG. 5 is an enlarged horizontal cross-section as along the line 5—5 of FIG. 4.
Figure 6:
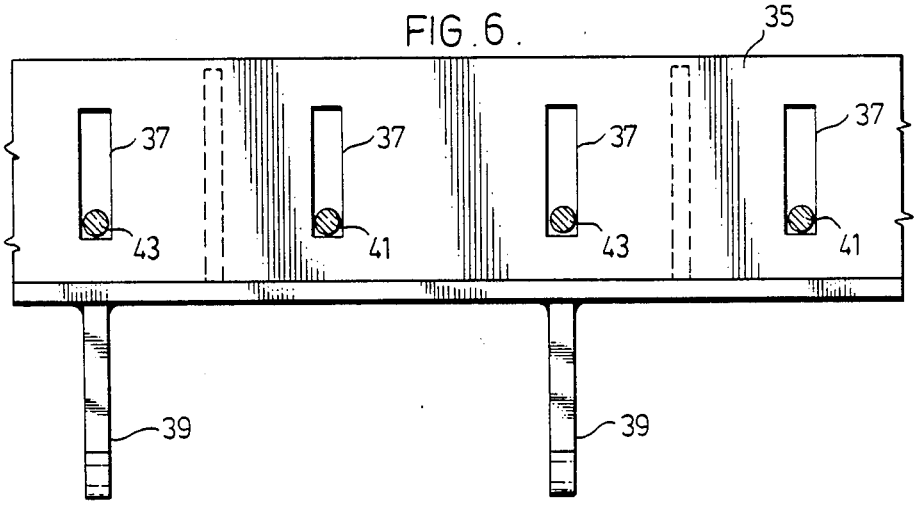
FIG. 6 is an enlarged front elevation, partly in cross-section showing the vertical flange of the connecting member.

The construction of a preferred connecting member D, as shown in FIGS. 3 to 5, is as follows. An elongated angle iron has a horizontal flange 31 resting on a platform formed on the abutment 33. The other flange 35 of the angle iron extends vertically upward from the abutment 33. The flange 35 is provided with a series of spaced-apart vertical slots 37. Extending downward from the flange 31 are hooked steel anchor members 39, embedded in the concrete of the abutment 33.

The top margin of the lower part 21 is bolted to the flange 35 by two types of bolts 41 and 43 respectively, extending through openings in the part 21 and through the slots 37.

The bolts 41 are of so-called frictionless type, that is, they are provided with frictionless washers 44 which bear against the flange 35. These washers are covered with a material having a low coefficient of friction, for example, polytetrafluoroethylene, known under the trade mark "Teflon".

The bolts 43 are ordinary high tension bolts having steel washers 42, intended to provide a firm clamping force between the flange 35 and the lower part 21, so as to be capable of transmitting both vertical and horizontal forces therebetween. The prime purpose of the frictionless bolts 41 is to transmit horizontal forces while permitting relative movement in the up and down direction between the lower part 21 and the flange 35 or, more important, movement relative to the footing 25 to which the flange 35 is rigidly connected in this embodiment.

For the purpose of connecting the margins of the upper part 17 to the connecting member D, the following structure is provided. An angle iron having flanges 47 and 49 is welded to the flange 31, as shown in FIG. 3. The flange 49 is provided with a series of spaced-apart holes 50. Bolts 51 extend through these holes and through holes in the margins of the upper part 17 to bolt the upper part 17 to the flange 49. There is at least one bolt for each pitch of the corrugation.

A fibreboard separator sheet 53 separates the concrete footing 25 from the lower part 21. The separator 53 is placed against the lower part 21 before the concrete is poured. Metal stiffeners 55 extend from the flange 35 to the flange 31 and are welded in place. These stiffeners are spaced-apart along the length of the flanges.

The structure described is constructed as follows. The initial portion of the fill C is placed and the lower part 21 applied tightly on top of it. The connecting members D are then bolted tightly to the respective margins of the lower part 21, along its length, using both bolts 41 and 43. Then, the margins of the upper part 17 are bolted, along its length, to the connecting members D using bolts 51.

The upper part 17 is provided with upwardly extending metal studs (not illustrated) and reinforcing steel is placed over it. Concrete is poured to embed the metal studs and the reinforcing steel to provide the cap 19 and the footings 25. Expediently an opening in the fill 29 may be provided to accomodate a key 26 of the concrete footing 25. A temporary form 28 may be employed to limit flow of the concrete at the end of the footing.

The concrete is allowed to set to say 70% of its normal strength. The bolts 43 are then loosened. Then, the backfill is complete to the road level. The pressure of the fill and the weight of the upper part 17 and cap 19 will cause the entire upper structure, including footing 25, to move down relative to the lower part 21, which stays more or less in its original position.

The extent to which the downward movement takes place depends on several factors. One of these is the degree of compaction and the quality of the underfill 29, the height and density of the fill over the culvert and the size of the culvert.

After the vertical movement is completed, the bolts 43 are tightened again, although may not always be necessary.

The downward movement of the upper part 17 of the structure does not influence the lower part 21 in the same manner as if the parts were fixedly connected. Therefore, there are not the forces to cause failure of the lower part 21 due to the settling effect as found with other structures.

As the footing 25 settles, this causes the vertical pressure applied to the fill under the footing to induce a horizontal pressure of the fill against the sides of the lower part 21. This, in turn, transfers forces through the joints formed by the connecting member D to the upper part 17 to limit outward movement of the margins of the upper part 17. Important functions of the lower part 21 are to prevent erosion of the fill C, particularly the portion 29 thereof beneath footings 25, and to provide a horizontal reaction to the outward movement of the upper part.

Figure 7:
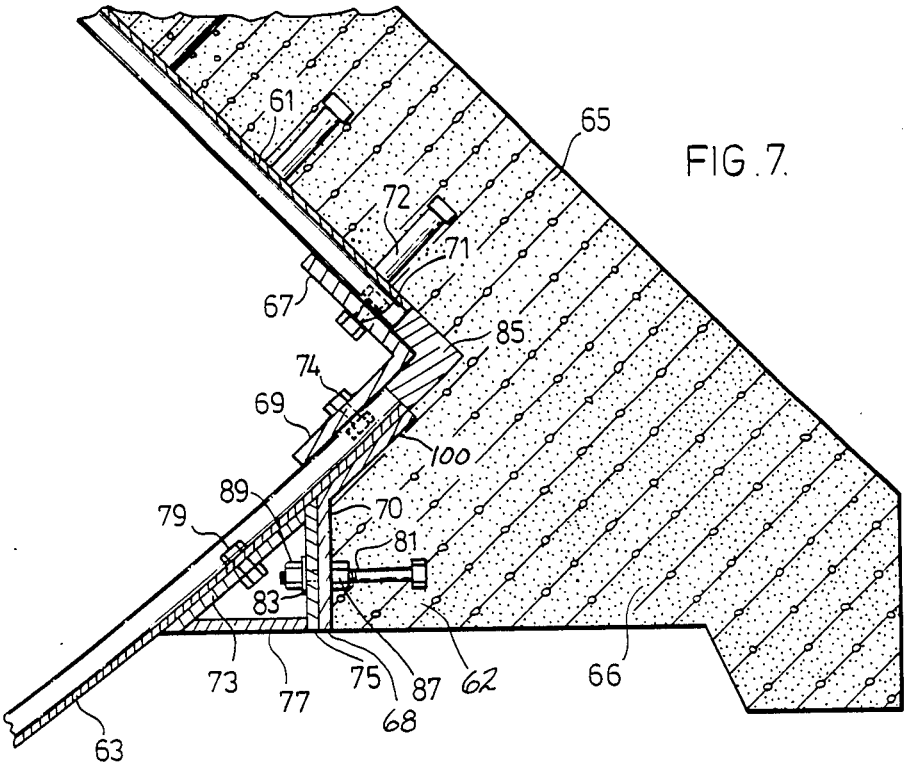
FIG. 7 is an enlarged fragmentary cross-section through one side of a bridge showing an alternative construction.
Figure 8:
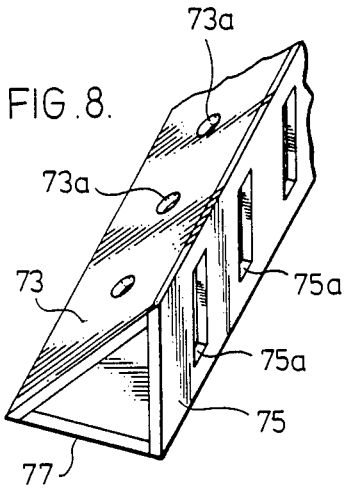
FIG. 8 is a perspective view of a first connecting member, as used in the construction of FIG. 7.
Figure 9:
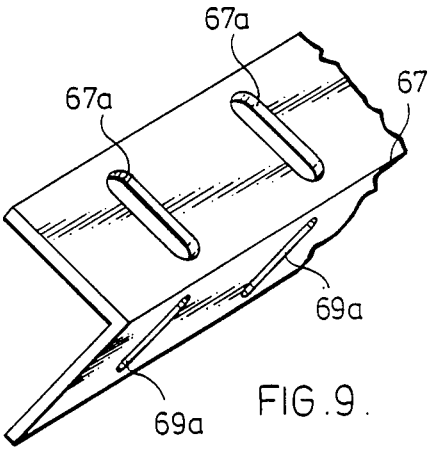
FIG. 9 is a perspective view of a second connecting member, as used in the construction of FIG. 7.

FIGS. 7 to 9 illustrate an alternative construction of culvert according to the invention.

Upper and lower corrugated metal parts are shown as 61 and 63 respectively, a concrete cap as 65, and footings at each side as 66. The overall construction is similar to that of the previous figures so the general arrangement will be understood from the earlier description.

The installation of the upper and lower arched parts 61 and 63 and the formation of the concrete cap is similar to that shown and described in connection with the embodiments of FIGS. 1 to 6.

The upper and lower parts 61 and 63 are connected together to assume the relative positions shown, forming a conduit and the concrete cap 65 is then formed in situ, over the upper part 61, with a footing 66 at each side of substantially the shape shown, by providing appropriate formwork to contain the concrete as it is poured. This footing includes an abutment 62 having an upper sloping platform 100 which extends beneath the margins of both the upper and lower parts 61 and 63. The platform 100 is inclined downwards from outside to inside and merges into a wall or platform 70 at its inner end, which is further inclined and preferably more or less vertical, as shown.

In accordance with this embodiment of the invention, the margins of the upper and lower parts 61 and 63 have a rigid connection by a first rigid connecting member, preferably in the form of an elongated angle iron having upper and lower flanges 67 and 69 at right angles to one another and provided with elongated slots **67*a* and 69*a* respectively. Bolts 71, provided with appropriate nuts, extend through holes in the margins of the parts 61 and 63 and through the slots 67*a* and 69*a*** to secure these parts together to form a conduit.

A second connecting member is provided in the form of an elongated rigid member, preferably steel, of triangular cross-section, having a first diagonal mounting plate 73, a second vertical mounting plate 75 and a horizontal stiffening base plate 77. The first mounting plate has holes **73*a* to receive bolts 79 extending through corresponding holes in the margin of the lower part 63. The second mounting plate has a series of slots 75*a* to receive the shanks of bolts 81 embedded in the concrete abutment of the footing 66, with appropriate nuts for tightening and a frictionless washer 83. By the bolts 81 and 79, the bottom part 63 is secured to the concrete footing 66** against relative horizontal movement.

A greased fibreboard separator sheet 68 is preferably placed between the concrete of the adjacent abutment and the margin of the lower part 63 and the face of the second connecting plate 75 and secured to the latter by two nuts 87 and 89. A plastic foam filler 85 is also placed between the end edges of the upper and lower parts 61 and 63 and the flanges 67 and 69 to exclude concrete from this space when the concrete cap 65 is formed.

The connection between the lower part 63 and the footing 66 through the second connecting member described permits relative vertical movement of the lower part 63 and the footing.

The bridge of the second embodiment is assembled and placed in a similar manner to that of the first described embodiment. First, the lower arched part 63 is partially embedded in fill $C_1$. The arched upper part 61 is then rigidly connected to the lower part 63 as described by the first connecting member through its flanges 67, 69. Then the second connecting member is attached to the lower part 63. The margin of the lower part 63 and plate 75 are lined on the outside surface by the greased fibreboard sheet 68, or the like, and a further portion of the fill is introduced to the level at which the footings 66 are to be located. The reinforced concrete cap 65 and footing 66 is then formed.

When the concrete of the cap 65 and the footings is cured to a sufficient degree, generally about 70% of its normal strength, the bolts 71 which rigidly interconnect the adjacent margins of upper and lower parts 61 and 63 are released somewhat, and the depth of the fill increased to the level of the roadbed of the bridge structure. Relative movement between the margins of the upper and lower parts 61 and 63 is permitted by the slotted openings *67a, 69a* in the connecting flanges 67 and 69. When the settling movement is substantially complate the bolts 71 may be tightened as in the earlier described embodiment. As before, the increasing weight of the fill bearing on the cap 65 causes a settling action of the footings 66, which slide downwards on frictionless bolts 81 while the lower part 63 remains stationary.

Advantages

From the above description, the advantages of the applicant's construction will be evident to one skilled in the art.

Both embodiments A (as shown in FIGS. 1 to 6) and B (as shown in FIGS. 7 to 9) have their own relative advantages.

For example, A utilizes a single connecting member which allows good control over its performance.

On the other hand, B allows for the use of the same curvature for steel plates of both parts of the structure (i.e. upper and lower) if so desired. A constant curvature along, say the bottom part, permits all joints being staggered.

The staggered joint of B permits a somewhat higher strength of the lower part than otherwise possible.

The upper parts are similar in both cases.

The embodiments of the invention in which an exclusive property or privilege is claimed are defined as follows:

1. A concrete arch buried bridge, comprising, a lower curved corrugated metal part resting on a compacted fill and having upper longitudinal margins, an upper arched corrugated metal part having lower longitudinal margins near said upper longitudinal margins and provided with a reinforced concrete cap having a footing at each side thereof, connecting means, connecting said upper and lower longitudinal margins to provide a conduit, to retain said upper arched corrugated metal part and said lower curved conrrugated metal part against relative horizontal movement while permitting limited relative vertical movement, said connecting means being tightenable to hold said upper and lower longitudinal margins against relative movement.

2. A concrete arch buried bridge, as defined in claim 1, in which each footing has an abutment extending inwardly of and beneath said lower longitudinal margins for anchoring said upper and lower longitudinal margins of the conduit to the footing.

3. A concrete arch buried bridge, as defined in claim 2, wherein said abutment has a substantially horizontal platform, an elongated base member anchored to said platform, an first mounting member connected to said lower curved corrugated metal part and said elongated base member, and a second upwardly extending mounting member connected to said elongated base member and to said lower longitudinal margins.

4. A concrete arch buried bridge, comprising, a conduit made up of an arched upper corrugated metal part having a lower longitudinal margin and a lower corrugated metal part having an upper longitudinal margin, said upper and lower longitudinal margins being disposed adjacent to each other and having a connection therebetween to form a conduit, and a reinforced concrete cap surmounting said arched upper corrugated metal part and having footings extending downwardly at each side thereof, comprising, an abutment extending inwardly from each footing under said lower longitudinal margins and provided with a horizontal mounting platform, mounting and connecting means providing the connection between the said upper and lower longitudinal margins and anchoring said conduit to said horizontal mounting platform to allow limited movement of said conduit relative to said abutment in a vertical direction but to restrict movement of said conduit in a horizontal direction, said mounting and connecting means comprising a mounting member including a base plate anchored to said horizontal mounting platform, a first mounting member connecting to and extending generally perpendicularly of said base plate, first connection means connecting said first mounting member to said upper longitudinal margin, a second mounting member connected to and extending generally upwardly of said base plate, and second connection means connecting said lower longitudinal margin to said second mounting member.

5. In a concrete arch bridge having a corrugated metal arched upper part having a lower longitudinal margin, a complementary corrugated metal lower part having an upper longitudinal margin, a concrete cap covering said corrugated metal arched upper part, and a first connecting means by which said upper longitudinal margin and said lower longitudinal margin are connected to each other and to said concrete cap, in which, said concrete cap is provided with footings, each footing having an abutment provided with a platform means extending downwardly beneath and inwardly of said lower longitudinal margin, said platform means comprising an upper platform extending diagonally downwardly beneath said upper longitudinal margin and merging with a lower platform extending substantially vertically downwardly of said upper platform, and a second connecting means connecting said corrugated metal lower part to said lower platform.

6. A concrete arch bridge, as defined in claim 5, in which said first connecting means comprises angle irons each having a flange bolted to said upper and lower longitudinal margins.

7. A concrete arch bridge, as defined in claim 5, in which said second connecting means comprises a connector having a first plate juxtaposed to said lower platform and secured thereto for limited movement in the up and down direction and a second plate extending diagonally therefrom to which said lower corrugated metal part is connected.

8. A concrete arch bridge, as defined in claim 5, in which said first connecting means comprises angle irons.

9. A concrete arch bridge, as defined in claim 6, in which said second connection means is a connector having a first plate juxtaposed to said lower platform and secured thereto for limited movement in the up and down direction and a second plate extending diagonally outwards from said first plate to which said corrugated metal lower part is connected.

10. A concrete arch buried bridge, comprising, a conduit made up of an arched upper corrugated metal part having a lower longitudinal margin and a lower corrugated metal part having an upper longitudinal margin, said upper and lower margins being disposed adjacent to each other and having a connection therebetween to form a conduit, and a reinforced concrete cap surmounting said arched upper corrugated metal part and having footings extending downwardly at each side thereof, comprising, an abutment extending inwardly from each footing under said lower longitudinal margin and provided with a horizontal mounting platform, mounting and connecting means providing said connection between said upper and lower longitudinal margins and anchoring said conduit to said horizontal mounting platform to allow limited movement of said conduit relative to said abutment in a vertical direction but to restrict movement of said conduit in a horizontal direction, said mounting and connecting means comprising a mounting member including a base plate anchored to said horizontal mounting platform, a first upwardly extending member connected to said base plate, and first connection means connecting said first upwardly extending member to said lower longitudinal margin, and second connection means connecting said lower corrugated metal part to said abutment.

11. A concrete arch buried bridge, comprising, a conduit made up of an arched upper corrugated metal part having a lower longitudinal margin and a lower corrugated metal part having an upper longitudinal margin, said upper and lower longtudinal margins being disposed adjacent to each other and having a connection therebetween to form a conduit, and a reinforced concrete cap surmounting said arched upper corrugated metal part and having footings extending downwardly at each side thereof, comprising, an abutment extending inwardly from each footing under said upper and lower longitudinal margins and provided with a mounting platform means, mounting and connecting means providing the connection between said upper and lower longitudinal margins and anchoring said conduit to said mounting platform means to allow limited movement of said conduit relative to said abutment in a vertical direction but to restrict movement of said conduit in a horizontal direction, said mounting platform means including an upper platform angled downwardly from the horizontal and an adjoining lower platform angled downwardly from the upper platform, anchoring means anchoring said upper longitudinal margin to said lower platform to permit limited movement in the up and down direction and to resist movement in the transverse direction, and connection means adjustably connecting said upper and lower longitudinal margins between a first position retaining them rigidly and a second position retaining them loosely for limited relative movement.

12. A method of constructing a concrete arch buried bridge, comprising, preparing a fill and placing a lower arched metal part having an upper longitudinal margin on said fill, placing an upper arched metal part having a lower longitudinal margin in complementary relationship to said lower arched metal part to form a conduit and forming tightened connections between the said upper and lower longitudinal margins by means of connecting members which prevent the relative movement of said upper and lower longitudinal margins in the upward and downward direction and prevent movement of said upper and lower longitudinal margins in the lateral direction, forming a concrete cap over said upper arched metal part, untightening said tightened connections to permit limited relative movement of said upper and lower longitudinal margins in the upward and downward direction, while preventing movement in the lateral direction, placing a fill over said conduit so installed to allow the said upper arched metal part and lower arched metal part to settle.

13. A method, as defined in claim 12, wherein, after said upper and lower arched metal parts have settled, said tightened connections are reformed between said upper and lower longitudinal margins by said connecting members so that further movement in the upward and downward direction is prevented.

* * * * *